United States Patent [19]

Cates

[11] Patent Number: 4,596,234

[45] Date of Patent: Jun. 24, 1986

[54] FIREPLACE DAMPER SYSTEM VIEWER, OPENER AND CLOSER

[76] Inventor: Dudley F. Cates, 165 E. 60th St., New York, N.Y. 10022

[21] Appl. No.: 699,025

[22] Filed: Feb. 7, 1985

[51] Int. Cl.[4] ..... F23L 3/00

[52] U.S. Cl. ..... 126/288; 126/286

[58] Field of Search ..... 126/286, 289, 288, 285 R, 126/120, 312, 202, 203; 294/9, 11, 13, 14; 81/177 A; D23/138.2

[56] References Cited

U.S. PATENT DOCUMENTS

| | | | |
|---|---|---|---|
| 2,581,304 | 1/1952 | Sims | 431/345 |
| 3,908,633 | 9/1975 | Ammons | 126/288 |
| 4,345,580 | 8/1982 | Speicher | 126/288 |
| 4,372,596 | 2/1983 | Sanders | 126/120 |
| 4,434,784 | 3/1984 | Van Patten | 126/200 |

OTHER PUBLICATIONS

"Wood Stove Fireplace and Equipment Directory", vol. III, 1980, p. 156.

*Primary Examiner*—James C. Yeung
*Attorney, Agent, or Firm*—Felfe & Lynch

[57] ABSTRACT

A tool for viewing and opening or closing a fireplace damper system has a bar handle for manipulating the tool and a damper adjustment bar at a fixed angle thereto for engaging the damper and adjusting it with the manipulation of the tool. A mirror unit near the bar joint provides a view of the damper engagement and adjustment. A light preferably illuminates this.

20 Claims, 6 Drawing Figures

FIREPLACE DAMPER SYSTEM VIEWER, OPENER AND CLOSER

BACKGROUND OF THE INVENTION

This invention relates, generally, to a fireplace tool or accessory and, more specifically, to a fireplace tool for flue damper system viewing, opening and closing.

A flue damper system is generally provided in a working fireplace for opening and closing the flue of the fireplace and, perhaps, controlling the draft of air through the flue for a fire. The damper system is generally located in the ceiling of the fire chamber of the fireplace with a downwardly-depending lever for manually adjusting the damper.

Accordingly, the lever is covered with soot from previous fires therebelow and can burn a person's hand if touched when fire heated. Many persons therefore try to use a poker for moving the damper, but its straight shape and the location of the damper system makes this awkward. Also, the location of the damper and even the depending damper-adjusting lever generally does not permit a person to see either directly without getting his (her) head near the floor or inside the fire chamber. Adjustments are often incorrect, therefore, leading to a fire with a closed damper and resulting smoke-filled room or no fire with an open damper and resulting draught. This situation is, therefore, in need of improvement.

SUMMARY OF THE INVENTION

Accordingly, it is an object of the present invention to provide a tool for adjusting a fireplace flue damper of the type described which allows observation of the damper or at least its adjusting lever while the adjustment is being made so that a person knows that the desired adjustment is being accomplished.

Another object is to provide a tool which can be used by a person standing comfortably upright and away from a hot fire.

Yet another object is to provide a tool which includes its own light for viewing a damper and/or its adjusting lever in a soot-dark fireplace.

Further objects of the invention will appear as the description proceeds.

To accomplish the above and further objects, the invention provides a tool having a bar handle and an aligned adjustment bar joined (including integrally) at one end to the bar handle at a fixed, although possibly adjustable, angle thereto of from about 45° to about 125°. The other end of the adjustment bar has a device for engaging a fireplace damper system, for example a crosspin for entering a hole in the downwardly-depending adjustment lever previously described when the tool is in use. As a result, the tool may be manipulated from the bar handle for opening or closing the damper, this operation suggesting the range for the fixed angle between the bars of from about 45° to about 125° in order to accomplish the adjustment while comfortably standing.

In order to view the damper opening and closing adjustment thus made, or confirm that it has been made, the tool also has a mirror unit on one of the bars near (including at) the joint therebetween. The mirror unit has at least a first mirror for viewing the damper-engaging device from a position proximate the plane defined by the aligned bars and within the angle therebetween, but angularly closer to the bar handle than the adjustment bar. Preferably, the mirror unit has a second mirror for viewing the damper-engaging device via the first mirror so that the image is not reversed. This contributes significantly to the ease of damper-adjusting manipulation.

Because the damper is usually in a dark and soot-blackened space, the tool also preferably has a light for illuminating the damper engaging device and, generally, the damper when the damper system is engaged, or could be. In this way, the damper adjustment can be first observed, and then adjusted, if desired, with visual confirmation of the adjustment from a convenient position in front of the fireplace and without touching the damper system itself.

BRIEF DESCRIPTION OF THE DRAWING

Preferred embodiments which illustrate but do not limit the invention are shown in drawings briefly described as follows.

DESCRIPTION OF THE PREFERRED EMBODIMENTS

Figure 1:
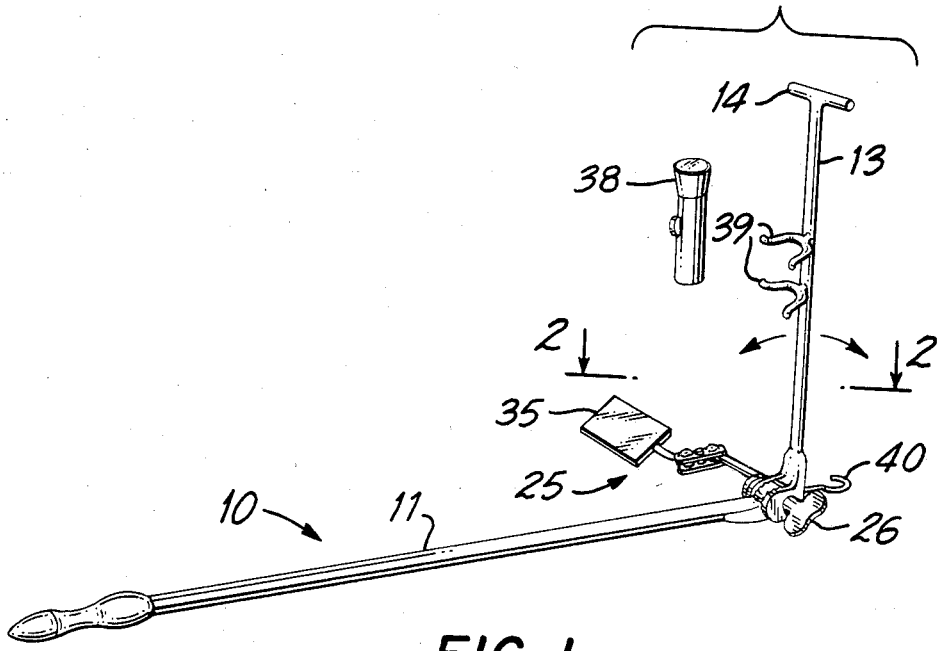
FIG. 1 is a perspective, partly-exploded view of one preferred embodiment.

One preferred embodiment of a fireplace damper viewer, opener and closer tool 10 according to the present invention is shown in FIG. 1. It has a bar handle 11 for being held at one end in a person's hand 12 (FIG. 5) and pivotally carrying one end of an adjustment bar 13 at the other end. The other end of the adjustment bar has a crosspin 14.

Figure 5:
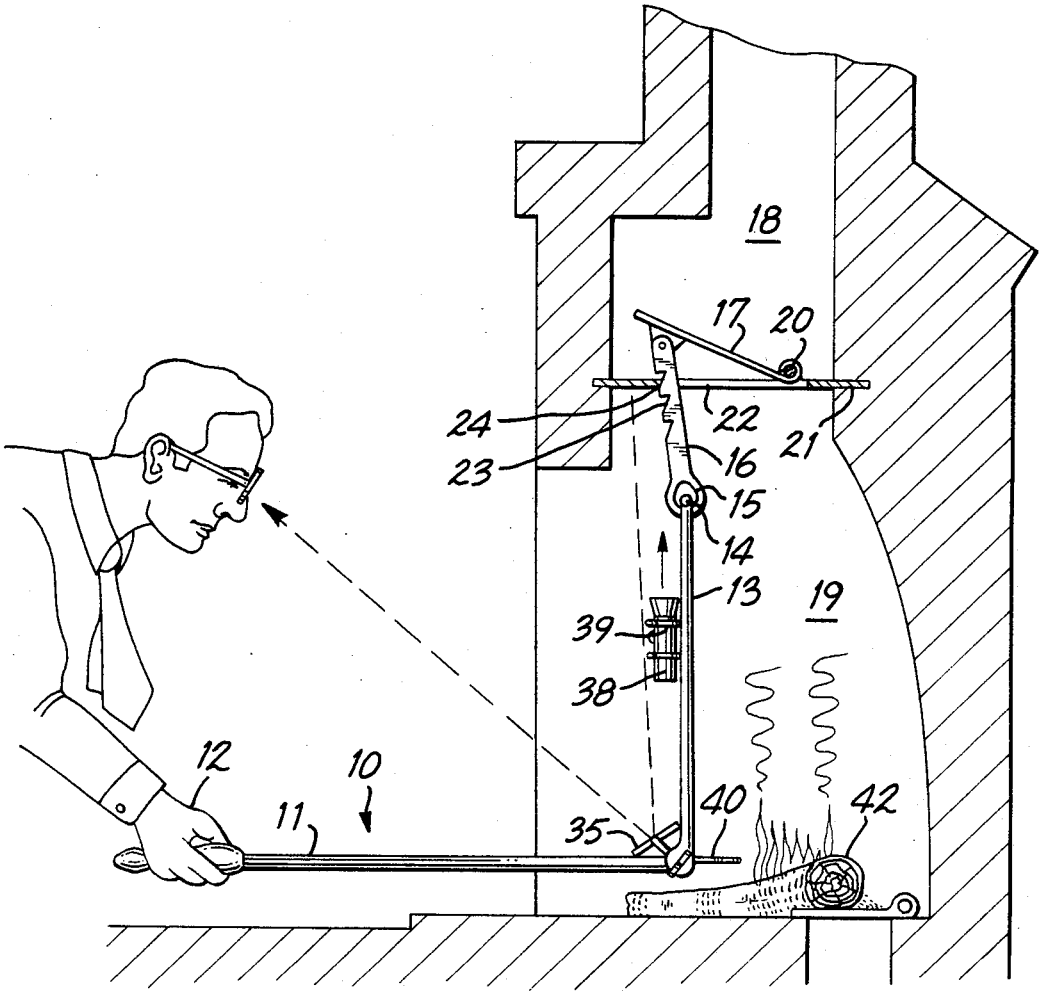
FIG. 5 is a side elevation of the embodiment of FIG. 1 shown in operative use to open or close a fireplace flue damper.

In use as shown in FIG. 5, the crosspin 14 engages a hole 15 in a downwardly-depending lever 16 of a damper 17 in a chimney flue 18 above a fireplace fire chamber 19. Such dampers are usually made upwardly pivotable about a hinge pin 20 on a horizontal plate 21 having a hole 22 thereby selectively closable by the damper and is, therefore, so shown. Notches 23 along the lever 16 engage an edge 24 of the plate hole to permit variable adjustment of the damper opening, as wished.

Figure 2:
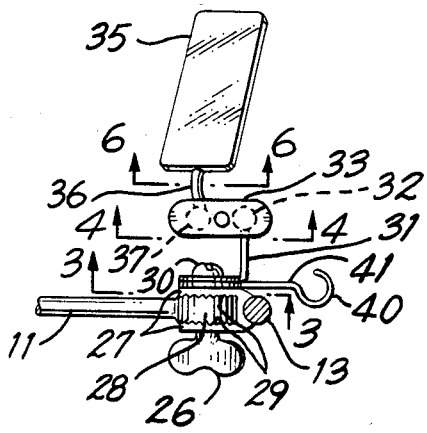
FIG. 2 is a partial plan view, partly in section, of the embodiment of FIG. 1 from line 2—2 of FIG. 1.

Returning to the embodiment of the invention shown in FIG. 1, an adjustable mirror unit 25 is supported on a wing bolt 26 about which the bars 11 and 13 are pivotable. As best shown in FIG. 2, the adjustment bar 13 is forked into side plates 27 between which a flattened end 28 of the bar handle 11 is fitted. The side plates and flattened end have aligned holes for receiving the bolt 26 to provide the pivot. A circle of radially-extending teeth 29 are formed on an inner side of each side plate and the outer sides of the flattened end in order to lock together the two bars at a fixed angle in a selected pivotal position relative to each other when the bolt is tightened in a nut 30. Adjustment is made possible by loosening the bolt in the nut sufficiently for the side plates to flex apart to widen the gap therebetween for relative rotation of the teeth 29 to the selected fixed angle. The fixed angle should be in the previously-indicated range for the previously-indicated reason.

Figure 4:
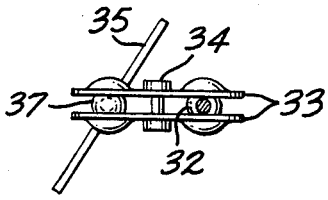
FIG. 4 is a partial elevation, partly in section, of the embodiment of FIG. 1 from line 4—4 of FIG. 2.
Figure 3:
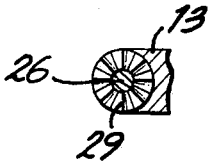
FIG. 3 is a partial elevation, partly in section, of the embodiment of FIG. 1 from line 3—3 of FIG. 2.

As best shown in FIGS. 2 and 4, the mirror unit 25 includes a right-angled bracket 31 having a hole (not shown) in one end for receiving the bolt 26. The opposite end of the bracket is spherically rounded to form a ball 32 for a socket joint between two cupped plates 33 held together by a rivet 34. A flat mirror 35, for example made of a polished steel to prevent fire damage, is integral with a stem 36. As with the bracket, the end of the stem is spherically rounded to form a second ball 37 for a socket joint between the same plates 33, but on the other side of the rivet. Thus, the mirror is adjustable to any angle so a person holding the bar handle 11 as shown in FIG. 5 can look into the mirror and see the crosspin 14 for engaging the lever hole 15 to adjust the damper and see the damper being adjusted to confirm the adjustment desired.

As shown in FIGS. 1 and 5, a flashlight 38 is detachably supported in spaced clamps 39 on the adjustment bar 13. It illuminates the damper lever 16 and damper 17 in the usual, soot-blackened darkness at the fireplace-ceiling location of the damper system as shown in FIG. 5.

A hook 40 is formed from a bent-up rod 41 having a flattened end with a hole (not shown) therethrough for receiving the bolt 26. The hook may be used like a poker to shift logs 42 when tending a burning fire in the fireplace, or to hang the tool for storage.

The single mirror 35 of the embodiment just described reverses the image seen and, for hooking the damper lever hole 15 with the crosspin 14, this is awkward. To avoid this, an embodiment having the mirror unit 25' shown in FIG. 6 may be used.

The mirror unit 25' is similar to the mirror unit 25 previously described, except that the flat mirror 35' has a second, flat mirror **35*a* at an angle thereto. The precise angle of the mirrors is not significant because the mirror unit is angularly adjustable and, in any event, the optics of the two mirrors for the function of the invention are well understood. Preferably, both mirrors are parallel to stem 36' so that the view thereby remains generally in the plane of the bars 11, 13**. As a result of the double reflection indicated, the image is not reversed to avoid the previously described awkwardness.

Figure 6:
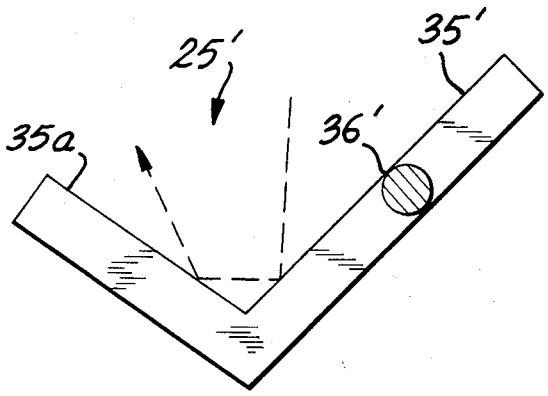
FIG. 6 is an elevation, partly in section, as though taken on line 6—6 of FIG. 2, but of another preferred embodiment.

The best mode now contemplated by the inventor includes the double mirror unit 25' of FIG. 6. It also has a housing fixedly holding the flashlight, mirror unit and bars in place of the clamps and pivot bolt arrangement previously described. These and other differences are, however, mere design changes to the invention described.

Thus, while certain features of the invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fireplace damper system viewer, opener and closer tool, comprising;

a bar handle;

means for opening and closing the damper when engaged with the damper system and manipulated from the bar handle comprising an adjustment bar, means for joining one end of the adjustment bar to the bar handle in alignment therewith and at a fixed angle thereto of from about 45° to about 125°, and damper-engaging means on the other end of the adjustment bar for engaging the damper system; and a mirror unit on one of the bars near the angled joint therebetween and comprising at least a first mirror for viewing the damper-engaging means from a position proximate the plane defined by the bar handle and the adjustment bar and within the angle therebetween, but angularly closer to the bar handle than the adjustment bar.

2. The tool of claim 1, wherein the means for joining the bars comprises means for fixedly joining the same.

3. The tool of claim 1, wherein the means for joining the bars comprise means for pivotally joining the same and fixing the angle thereof.

4. The tool of claim 1, wherein the damper-engaging means comprises a crosspin.

5. The tool of claim 2, wherein the damper-engaging means comprises a crosspin.

6. The tool of claim 3, wherein the damper-engaging means comprises a crosspin.

7. The tool of claim 1, wherein the mirror unit further comprises a second mirror for viewing the damper-engaging means via the first, whereby to avoid reversing the image thereof.

8. The tool of claim 2, wherein the mirror unit further comprises a second mirror for viewing the damper-engaging means via the first, whereby to avoid reversing the image thereof.

9. The tool of claim 3, wherein the mirror unit further comprises a second mirror for viewing the damper-engaging means via the first, whereby to avoid reversing the image thereof.

10. The tool of claim 4, wherein the mirror unit further comprises a second mirror for viewing the damper-engaging means via the first, whereby to avoid reversing the image thereof.

11. The tool of claim 5, wherein the mirror unit further comprises a second mirror for viewing the damper-engaging means via the first, whereby to avoid reversing the image thereof.

12. The tool of claim 6, wherein the mirror unit further comprises a second mirror for viewing the damper-engaging means via the first, whereby to avoid reversing the image thereof.

13. The tool of claim 1, and further comprising a light on the tool for illuminating the damper-engaging means.

14. The tool of claim 2, and further comprising a light on the tool for illuminating the damper-engaging means.

15. The tool of claim 3, and further comprising a light on the tool for illuminating the damper-engaging means.

16. The tool of claim 4, and further comprising a light on the tool for illuminating the damper-engaging means.

17. The tool of claim 7, and further comprising a light on the tool for illuminating the damper-engaging means.

18. The tool of claim 8, and further comprising a light on the tool for illuminating the damper-engaging means.

19. The tool of claim 9, and further comprising a light on the tool for illuminating the damper-engaging means.

20. The tool of claim 11, and further comprising a light on the tool for illuminating the damper-engaging means.

* * * * *